United States Patent [19]

Adachi et al.

[11] Patent Number: 5,005,459

[45] Date of Patent: Apr. 9, 1991

[54] MUSICAL TONE VISUALIZING APPARATUS WHICH DISPLAYS AN IMAGE OF AN ANIMATED OBJECT IN ACCORDANCE WITH A MUSICAL PERFORMANCE

[75] Inventors: Takeshi Adachi; Kotaro Mizuno; Shigeru Yamada; Hideo Suzuki; Mamoru Kimpara, all of Hamamatsu, Japan

[73] Assignee: Yamaha Corporation, Hamamatsu, Japan

[21] Appl. No.: 542,639

[22] Filed: Jun. 22, 1990

Related U.S. Application Data

[63] Continuation of Ser. No. 231,076, Aug. 11, 1988, abandoned.

[30] Foreign Application Priority Data

| | | | |
|---|---|---|---|
| Aug. 14, 1987 | [JP] | Japan | 62-201803 |
| Aug. 25, 1987 | [JP] | Japan | 62-209288 |
| Aug. 28, 1987 | [JP] | Japan | 62-212679 |
| Oct. 2, 1987 | [JP] | Japan | 62-248122 |

[51] Int. Cl.[5] ..... G10G 1/00

[52] U.S. Cl. ..... 84/453; 84/462; 84/478

[58] Field of Search ..... 84/94.1, 94.2, 95.1, 84/95.2, 453, 462, 477 R, 478, DIG. 1, DIG. 6, DIG. 12, DIG. 27

[56] References Cited

U.S. PATENT DOCUMENTS

| | | | |
|---|---|---|---|
| 4,352,311 | 10/1982 | Luce et al. | 84/1.19 |
| 4,386,550 | 6/1983 | Newsome et al. | 84/464 |
| 4,538,495 | 9/1985 | Sato | 84/1.19 |
| 4,551,029 | 11/1985 | Aizawa | 84/1.01 X |
| 4,670,820 | 6/1987 | Eddins et al. | 84/94.1 |
| 4,742,748 | 5/1988 | Tateishi | 84/1.03 |
| 4,748,856 | 6/1988 | Sato | 84/1.03 |
| 4,754,680 | 7/1988 | Morikawa et al. | 84/1.22 |
| 4,757,736 | 7/1988 | Tajima | 84/1.03 |

*Primary Examiner*—Stanley J. Witkowski

*Attorney, Agent, or Firm*—Spensley Horn Jubas & Lubitz

[57] ABSTRACT

A musical tone visualizing apparatus includes at least an image memory for storing plural images relating to players and/or musical instruments of an orchestra, a display unit for displaying the images on a display screen thereof and a display control circuit for controlling the display unit so that displayed images can be varied in response to an inputted musical tone signal or inputted performance information outputted from an electronic musical instrument, for example. Hence, it is possible to move the players and musical instruments in response to performance of the electronic musical instrument, and it is also possible to selectively enlarge one display image of the player and musical instrument whose tone volume is the largest. Thus, the displayed images can be automatically varied in response to the performance of the electronic musical instrument.

38 Claims, 10 Drawing Sheets

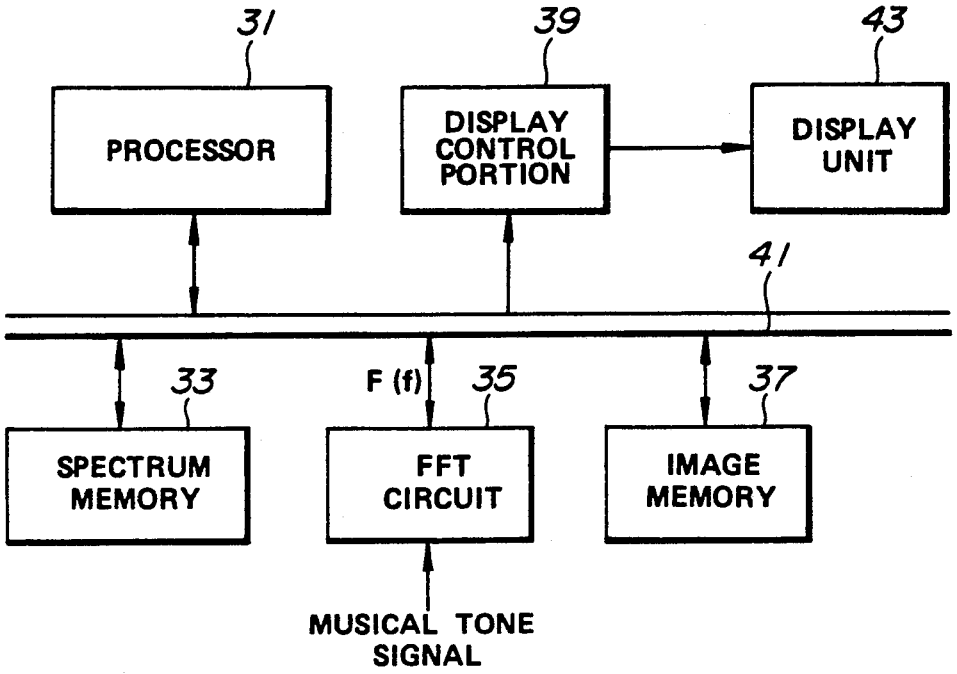
FIG.4
FIG.5 A
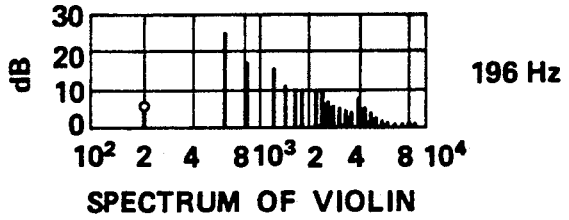
FIG.5 B
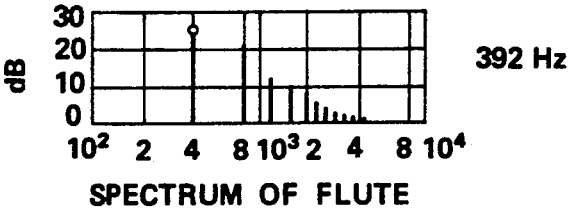

MUSICAL TONE VISUALIZING APPARATUS WHICH DISPLAYS AN IMAGE OF AN ANIMATED OBJECT IN ACCORDANCE WITH A MUSICAL PERFORMANCE

This is a continuation of application Ser. No. 231,076, filed on Aug. 11, 1988 and now abandoned.

BACKGROUND OF THE INVENTION

1. Field of the Invention

This invention relates to a musical tone visualizing apparatus, and more particularly to a musical tone visualizing apparatus which can change the contents of display images in response to, e.g, the scale and kinds of musical instruments for generating musical tones.

2. Prior Art

Conventionally, it has been known that there is an apparatus for detecting a parameter such as tone volume or frequency (i.e., tone pitch) of a musical tone to be generated in response to performance of a musical instrument so that the contents of a display screen of a video display unit can be controlled based on the parameter. By using such apparatus, it becomes possible to effectively enjoy music from a visual aspect in addition to an auditory aspect.

However, such conventional apparatus controls the display screen by use of only the parameter such as, e.g., the tone volume frequency. Hence, it is disadvantageous in that the contents of the display screen do not match with the contents of musical tones in some cases.

SUMMARY OF THE INVENTION

It is accordingly a primary object of the present invention to provide a musical tone visualizing apparatus which can execute image control exactly in response to the organization of the musical instruments for generating the inputted musical tones so that compatibility between the inputted musical tones or information and the display image will be improved.

It is another object of the present invention to provide a musical tone visualizing apparatus which can control the contents of display images or display states based on rhythm information extracted from musical signals or musical tone performance information so that the image display can match with the rhythm of the musical tone signal and it will be possible to effectively enjoy the music from both of the auditory and visual aspects.

It is still another object of the present invention to provide a musical tone visualizing apparatus which can execute image display exactly corresponding to the contents of parameters representative of characteristics of the inputted musical tones so that the compatibility between the inputted musical tones or performance information and the display images will be improved.

It is a further object of the present invention to provide a musical tone visualizing apparatus which can execute the image display exactly corresponding to the parameter of a musical tone such as the tone color, tone pitch, tone volume and tempo of the inputted musical tone so that the image display will match with the musical tone.

In a first aspect of the invention, there is provided a musical tone visualizing apparatus comprising:

(a) detecting means for obtaining organization information representative of the organization of musical instruments from a musical tone signal or musical tone performance information;

(b) image display means for displaying a predetermined image; and (c) display control means for varying the image displayed by the image display means in response to the organization information outputted from the detecting means.

In a second aspect of the invention, there is provided a musical tone visualizing apparatus comprising:

(a) a microphone for collecting musical tones generated by an orchestra to thereby output musical tone signals;

(b) means for detecting organization scale of the orchestra based on the musical tone signals and for outputting a control signal corresponding to the detected organization scale of the orchestra;

(c) a plurality of video units each outputting a video signal corresponding to images of players and/or musical instruments, organization scale designated by one video unit being different from that designated by another video unit;

(d) selecting means for selecting one of the video signals outputted from the video units in accordance with the control signal; and (e) display means for displaying the images based on the selected video signal, whereby the display means displays the images corresponding to the organization scale of the orchestra.

In a third aspect of the invention, there is provided a musical tone visualizing apparatus comprising:

(a) tone color selecting means for selectively outputting tone color information concerning tone colors;

(b) key information generating means for generating key information based on performance of a keyboard;

(c) memory means for pre-storing image information concerning images of players and/or musical instruments;

(d) control means for reading the image information from the memory means based on the tone color information and the key information; and (e) display means for displaying the images corresponding to the image information, the images being varied based on the tone color information and the key information under control of the control means.

In a fourth aspect of the invention, there is provided a musical tone visualizing apparatus comprising:

(a) spectrum memory means for pre-storing fundamental spectrum information by every tone color;

(b) means for executing the Fast Fourier Transform on an inputted musical tone signal so that spectrum analysis will be effected on the musical tone signal to thereby obtain a spectrum component;

(c) image memory means for pre-storing images of players and/or musical instruments;

(d) control means for comparing the spectrum component with the fundamental spectrum information to thereby detect a kind of musical instrument which is presently played; and (e) display means for selecting the image corresponding to the detected kind of musical instrument from the images stored in the image memory means to thereby display the selected image on a display screen thereof.

In a fifth aspect of the invention, there is provided a musical tone visualizing apparatus comprising:

(a) detecting means for detecting rhythm information representative of a rhythm kind from a musical tone signal or musical tone performance information;

(b) image displaying means for displaying an image based on given image information; and (c) display control means for varying contents or display states of the image displayed by the image display means based on the rhythm information.

In a sixth aspect of the invention, there is provided a musical tone visualizing apparatus comprising:

(a) an electronic musical instrument for outputting performance information in a certain musical data format, the electronic musical instrument providing rhythm selecting switches for selecting a desirable rhythm kind;

(b) control means for extracting rhythm information from the performance information, the rhythm information including at least rhythm kind information representative of the selected rhythm kind, key-on information indicative of tone generation of each rhythm musical instrument and velocity information for controlling tone volume level of each rhythm musical instrument;

(c) memory means for storing data representative of a kind of each rhythm musical instrument;

(d) image memory means for storing image information indicative of the rhythm musical instruments, the image memory means inputting the data read from the memory means, so that the image information indicative of the rhythm musical instrument corresponding to the selected rhythm kind is outputted therefrom; and (e) display means for displaying at least an image of the selected rhythm musical instrument which is designated to generate a rhythm musical tone based on the key-on information, whereby a display size of the image of the selected musical instrument is controlled based on the velocity information.

In a seventh aspect of the invention, there is provided a musical tone visualizing apparatus comprising:

(a) image display means for displaying predetermined images each corresponding to each of plural kinds of tone colors;

(b) performance information detecting means for detecting the tone color and its performance state of a performance tone based on an inputted musical tone signal or inputted performance information; and (c) display control means for varying the image corresponding to the detected tone color in response to the detected tone color and its performance state.

In an eighth aspect of the invention, there is provided a musical tone visualizing apparatus comprising:

(a) image display means for displaying pictures of musical instruments respectively corresponding to plural kinds of tone colors;

(b) performance information detecting means for detecting the tone color and its performance state of a performance tone based on an inputted musical tone signal or inputted performance information;

(c) position information storing means for storing position information concerning a position of each musical instrument;

(d) tone image control means for controlling a position of a tone image corresponding to each tone color based on information concerning the tone image; and (e) display control means for varying corresponding picture of musical instrument in response to the detected tone color and its performance state.

In a ninth aspect of the invention, there is provided a musical tone visualizing apparatus comprising:

(a) a keyboard;

(b) a plurality of tone generators each generating a musical tone signal of each tone color based on performance of the keyboard;

(c) a plurality of tone color selecting switches each connected to each of the tone generators, one or some of the tone color selecting switches being selectively turned on by a player in advance of the performance of the keyboard;

(d) detecting means for inputting the musical tone signals outputted from the tone generators via the tone color selecting switches and then detecting levels of the musical tone signals to thereby select the musical tone signal whose tone volume is maximum, the detecting means outputting information concerning the musical instrument of the maximum tone volume; and (e) display means for displaying several kinds of pictures of musical instruments based on pre-stored image information in advance, the display size of a picture of musical instrument of the maximum tone volume within the displayed pictures of musical instruments being enlarged based on the information outputted from the detecting means.

In a tenth aspect of the invention, there is provided a musical tone visualizing apparatus comprising:

(a) first parameter detecting means for detecting a first musical tone parameter from an inputted musical tone signal or inputted performance information;

(b) second parameter detecting means for detecting a second musical tone parameter from the inputted musical tone signal or inputted performance information, the second musical tone parameter being set different from the first musical tone parameter;

means for displaying an image of object corresponding to the first musical tone parameter detected by the first parameter detecting means; and (d) display control means for moving or varying a display image of the object in response to the second musical tone parameter detected by the second parameter detecting means.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings:

FIG. 4 is a block diagram showing diagrammatic constitution of the musical tone visualizing apparatus according to a third embodiment of the present invention;

FIGS. 5A and 5B are graphs each showing an example of spectrum distribution of each musical instrument;

DESCRIPTION OF THE PREFERRED EMBODIMENTS

Figure 1:
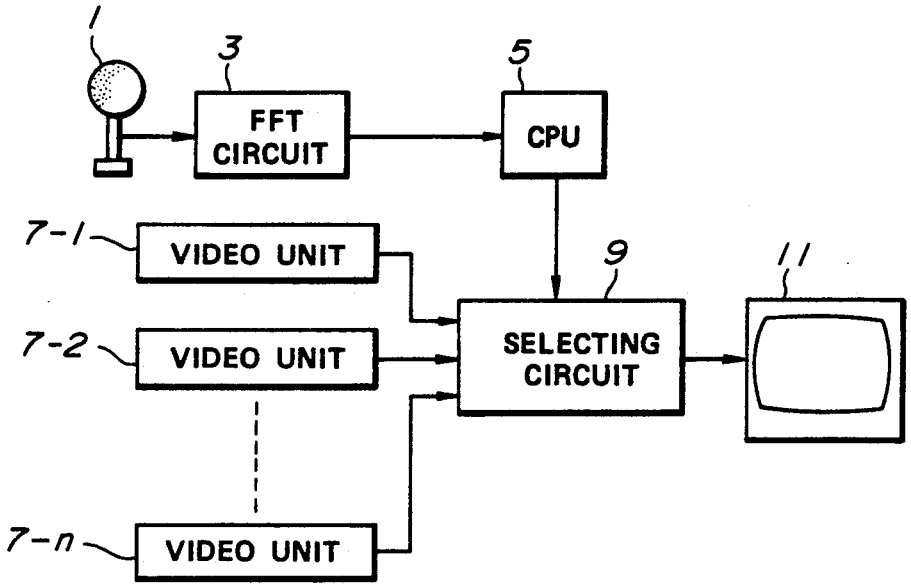
FIG. 1 is a block diagram showing diagrammatic constitution of the musical tone visualizing apparatus according to a first embodiment of the present invention.

Hereinafter, description will be given with respect to the preferred embodiments of the present invention by referring to the drawings wherein like reference characters designate like or corresponding parts throughout the several views.

[A] FIRST EMBODIMENT

FIG. 1 is a block diagram showing the diagrammatic constitution of the musical tone visualizing apparatus according to the first embodiment of the present invention. This apparatus comprises a microphone 1 for collecting the musical tones, a FFT circuit 3 for executing the Fast Fourier Transform (FFT), a central processing unit (CPU) 5 constituted by microprocessors etc., video units 7-1 to 7-n (wherein n denotes an arbitrary integral number) such as video tape recorders, a selecting circuit 9 for selecting one of signals outputted from these video units and an image display unit 11 such as a CRT display unit for displaying predetermined images based on the selected output signal of the video unit.

In the apparatus shown in FIG. 1, the musical tone signals collected by the microphone 1 are inputted to the FFT circuit 3 wherein the musical tone signals are subjected to spectrum analysis and then supplied to the CPU 5. Then, the CPU 5 judges the organization scale of the musical instruments for generating the musical tones based on the inputted spectrum information. More specifically, the CPU 5 judges the number of spectrums included in the input signals, spectrum range, spectrum variation and curve of spectrum waveform, for example. If values of these matters are relatively large, the CPU 5 judges that the organization scale of the musical instruments is relatively large, for example. Based on such judgment, the CPU 5 outputs a control signal to the selecting circuit 9 Hence, the selecting circuit 9 selects the video unit which outputs the image signal corresponding to the organization scale of the musical instruments, and then the display unit 11 displays the image by use of the selected image signal. Each of the video units 7-1 to 7-n memorizes an image of an orchestra whose organization scale can be gradually enlarged by varying the number of the musical instruments or players for example. Thus, the display unit 11 displays the image corresponding to the organization scale of the orchestra which generates the musical tones detected by the microphone 1, so that image display corresponding to the contents of the musical tones will be executed.

Figure 2:
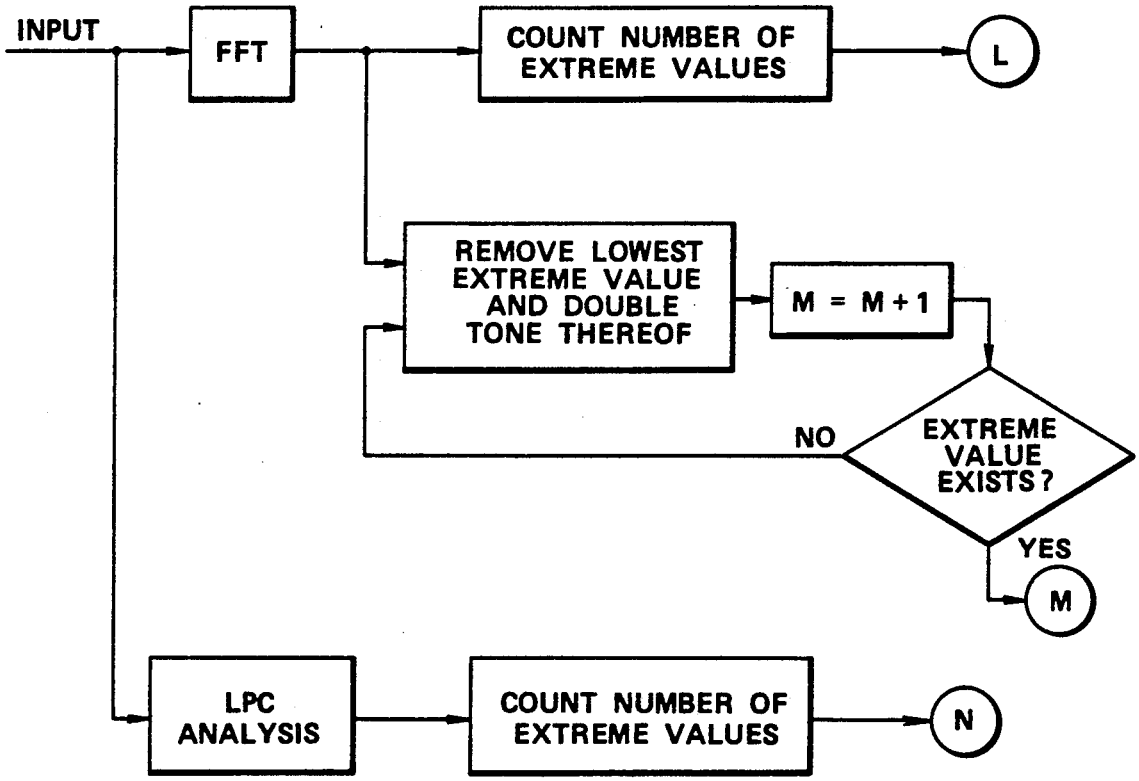
FIG. 2 is a drawing for explaining a sequential process for obtaining organization scale of the musical instruments in the apparatus shown in FIG. 1.

FIG. 2 shows a sequential process of the CPU 5 in the apparatus shown in FIG. 1. As shown in FIG. 2, the inputted musical tone is subjected to the spectrum analysis by the FFT circuit 3. Then, the CPU 5 count the number of spectrums each which have a peak value which is larger than a certain constant value, i.e., a number of extreme values. Hence, the CPU 5 stores such counted number as number L. This number L is used as one of parameters indicative of the organization scale of musical instruments. In addition, a spectrum having an extreme value of lowest frequency and another spectrum having double tone pitch thereof are removed from the spectrums included in the inputted musical tones, and then "1" is added to a value M. The above-mentioned process repeatedly executed until the extreme value no longer exists. Then, the finally obtained value M is stored. This value M corresponds to the kinds of musical instruments, and this value M is also used as one of the parameters representative of the organization scale of the musical instruments.

As another method for detecting the organization scale of the musical instruments, it is possible to adopt LPC analysis, i.e., linear predictive coding method. In this case, the number of extreme values detected by this method is counted, and then the counted number is stored as a number N. This number N is also used as one of the parameters representative of the organization scale of the musical instruments.

The values of these parameters L, M and N which are obtained as described heretofore are respectively multiplied by coefficients a, b and c, and then the obtained values are added together to thereby obtain a value K representative of an organization degree of musical instruments. In other words, the value K is obtained from the following formula.

$$k=a\cdot L+b\cdot M+c\cdot N$$

In the above formula, the coefficients a, b and c are respectively determined empirically, and at least one of these coefficients is not set equal to "0". Such obtained value K is considered as the value representative of the organization scale of the musical instruments. Hence, the selecting circuit 9 shown in FIG. 1 is controlled by use of this value K so that the image corresponding to the organization scale of the musical instruments will be displayed. Incidentally, it is obvious that it is not necessary to use all of the parameters L, M and N.

[B]SECOND EMBODIMENT

Figure 3:
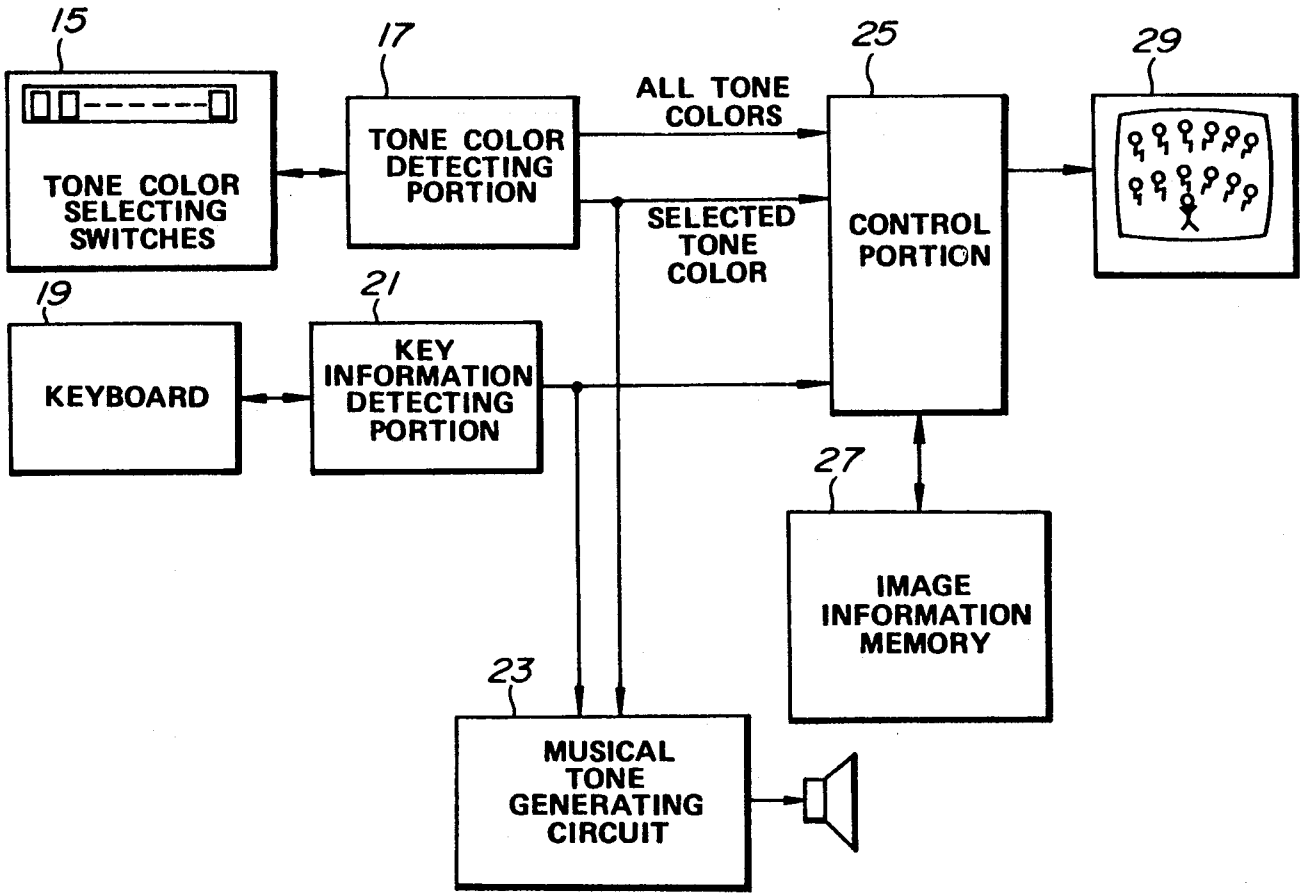
FIG. 3 is a block diagram showing constitution of the musical tone visualizing apparatus according to a second embodiment of the present invention.

FIG. 3 shows the constitution of the musical tone visualizing apparatus according to the second embodiment of this invention. The apparatus shown in FIG. 3 comprises a tone color detecting portion 17 which inputs tone color information from tone color selecting switches 15 of an electronic musical instrument, a key information detecting portion 21 which inputs key information from a keyboard 19 of an electronic musical instrument, a musical tone generating circuit 23, a control portion 25, an image information memory 27 and an image display unit 29 such as the CRT display unit.

In the apparatus shown in FIG. 3, the tone color detecting portion 17 takes information representative tone colors used in the performance based on operating the states of the tone color selecting switches 15, and then such information is supplied to the musical tone generating circuit 23. The key information detecting portion 21 detects the key information such as key-on/off information and key codes corresponding to depressed keys, and then such key information is supplied to the musical tone generating circuit 23. Thus, the musical tone generating circuit 23 generates the musical tone in the known method based on the above-mentioned information.

In addition to the information concerning the selected tone color selecting switch, the tone color detecting portion 17 generates information concerning all of the tone colors which can be outputted by the electronic instrument based on information representative of the number of tone color selecting switches and other information, and such generated information is also supplied to the control portion 25. In addition, the key information detecting portion 21 outputs the key information concerning the key-on/off and key codes described before to the control portion 25. The control portion 25 controls the image information outputted from the image information memory 27 based on a variety of information to thereby display predetermined images on a display screen of the display unit 29 More specifically, the control portion 25 detects the kinds of musical instruments based on the information concerning all tone colors outputted from the tone color detecting portion 17, so that an image of an orchestra corresponding to these musical instruments will be displayed on the display screen of the display unit 29.

Further, based on the information concerning the selected tone colors outputted from the tone color detecting portion 17, i.e., the information representative of the tone colors performed by the electronic musical instrument and another key information outputted from the key information detecting portion 21, the control portion 25 can control the display images so that the players of the orchestra will be moved in accordance with predetermined movements i.e., animated images are displayed. In other words, all tone colors of the used electronic musical instrument are considered as the players of the orchestra; images of these players are arranged on the display screen; the player of the musical instrument corresponding to the actually performed tone color moves in accordance with performance movement thereof, while a player of sole part stands up and moves in accordance with a solo performance movement. In addition, an image of a conductor is controlled so that a conductor will swing a baton in response to a performance rhythm tempo. Such display control of the images can be easily executed by computer graphic techniques, hence, detailed description thereof will be skipped.

Incidentally, the case where the selected tone color i.e., the selected musical instrument corresponds to the solo part is identical to the case where the lead tone color is selected. In this case, it is possible to execute the above-mentioned display control so that the player will stand up at a timing when the tone color selecting switch is turned on and then the player will play the performance while the player is standing up. Meanwhile, the tone colors of the strings need a plurality of players. In the case where such tone colors are selected, it is possible to execute the display control so that the players will not stand up even when the tone color selecting switch is operated but the players will move in accordance with the performance movements while the players are sitting. Based on such display control described heretofore, it is possible to further improve the compatibility between the display images and the musical tones.

[C] THIRD EMBODIMENT

FIG. 4 shows the constitution of the musical tone visualizing apparatus according to the third embodiment of this invention. The apparatus shown in FIG. 4 comprises a processor 31 constituted by the microprocessors etc., a spectrum memory 33 storing reference spectrum information in response to the musical instrument (i.e., the tone color), a FFT circuit 35 for executing the Fast Fourier Transform on the inputted musical tone signals, an image memory 37 and a display control portion 39, all of which are connected to each other by a bus line 41. In addition, a display unit 43 such as the CRT display unit is connected to the display control portion 39.

FIGS. 5A and 5B respectively show the spectrum components of a violin and a flute in a predetermined tone pitch frequency. More specifically, waveforms of the musical tone include a fundamental wave and integer-harmonic waves (or tones). For this reason, the spectrum memory 33 stores the level of each spectrum by every fundamental wave and by the harmonic wave of every degree, so that it becomes possible to execute a pattern recognition of each musical tone, i.e., detection of musical instrument. More specifically, the musical tone signal is subjected to the spectrum analysis by the FFT circuit 35 so that the spectrum components of the musical tone can be obtained, and then these spectrum components are compared with reference spectrum information stored in the spectrum memory 33 so that the kind of the musical instrument can be detected. Thus, the display unit 43 displays the images corresponding to a single musical instrument or plural musical instruments which are detected as described heretofore. As the images displayed on the display screen of the display unit 43, it is possible to use the pictures of the detected musical instruments themselves or waveforms of the musical tones which are outputted from the detected a musical instruments.

Figure 6:
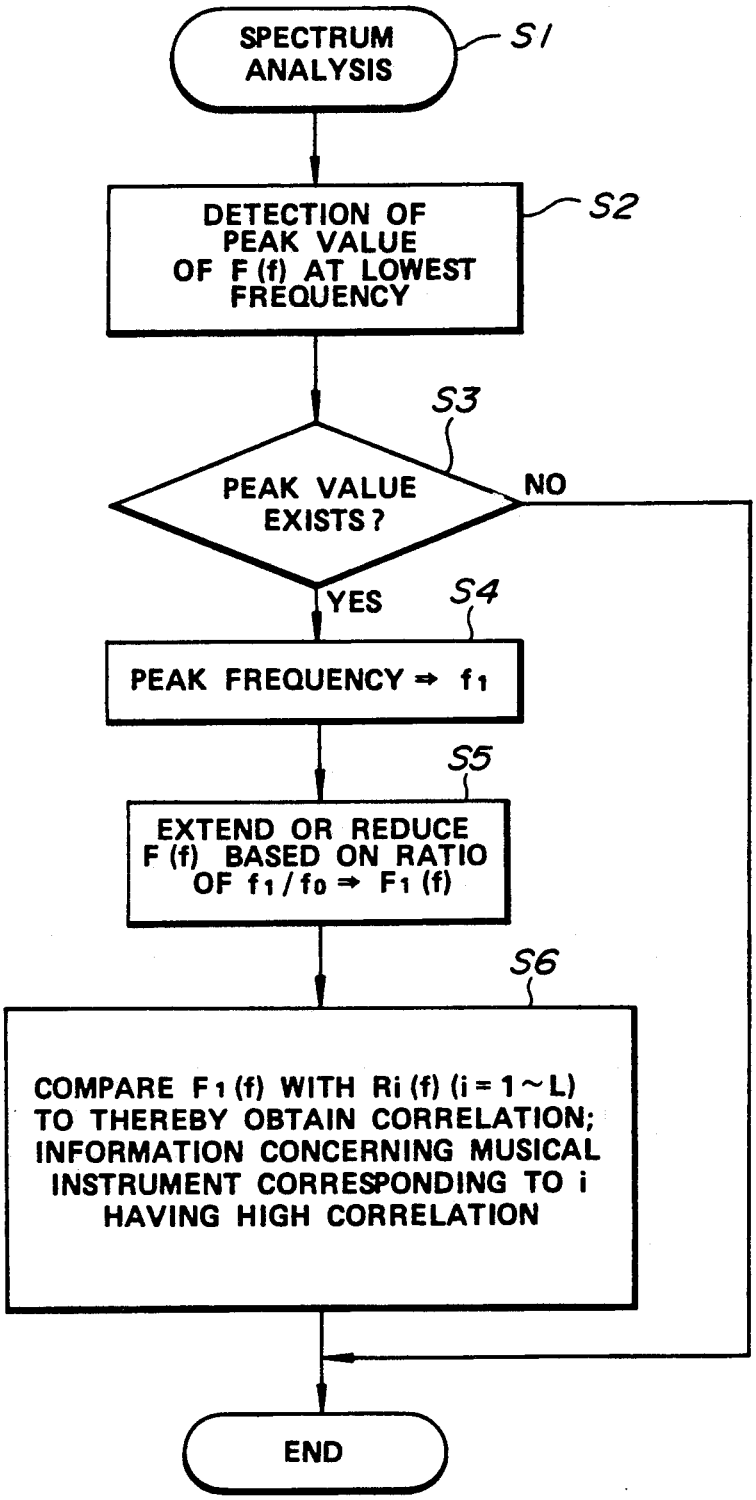
FIGS. 6 and 7 are flowcharts for explaining operations of the apparatus shown in FIG. 4.

Next, description will be given with respect to musical instrument detecting process in the apparatus shown in FIG. 4 by referring to FIG. 6. FIG. 6 shows a procedure for detecting the kind of the musical instrument in the case where the inputted musical tone signal is generated from a single tone, i.e., a single musical instrument (or a single tone color). In this case, $f_O$ is set as the fundamental frequency of the spectrum, and the spectrum memory 33 (shown in FIG. 4) prestores spectrum information $R_1(f)$, ..., $R_N(f)$ of the musical instruments having musical instrument number of $i=1$, ..., L. In addition, a signal F(f) is obtained by subjecting the inputted musical tone signal to the spectrum analysis by the FFT circuit 35 in a step S1. Then, a peak value of lowest frequency included in this signal F(f) is detected in a step S2. In the case where this peak value is detected, the frequency of this peak value is denoted by $f_1$ (in steps S3 and S4). Next, the function F(f) is extended or reduced based on a ratio of $f_1/f_O$ to thereby obtain a function $F_1(f)$ (in a step S5). Then, the value of function $F_1(f)$ is compared with each value of the spectrum information $R_i(f)$ (where $i=1$, ..., L) stored in the spectrum memory 33 to thereby obtain correlation thereof. Thereafter, the value i corresponding to the spectrum data $R_i(f)$ having the high correlation is detected, and then the information concerning the kind of the corresponding musical instrument will be obtained based on this detected value i (in a step S6).

Figure 7:
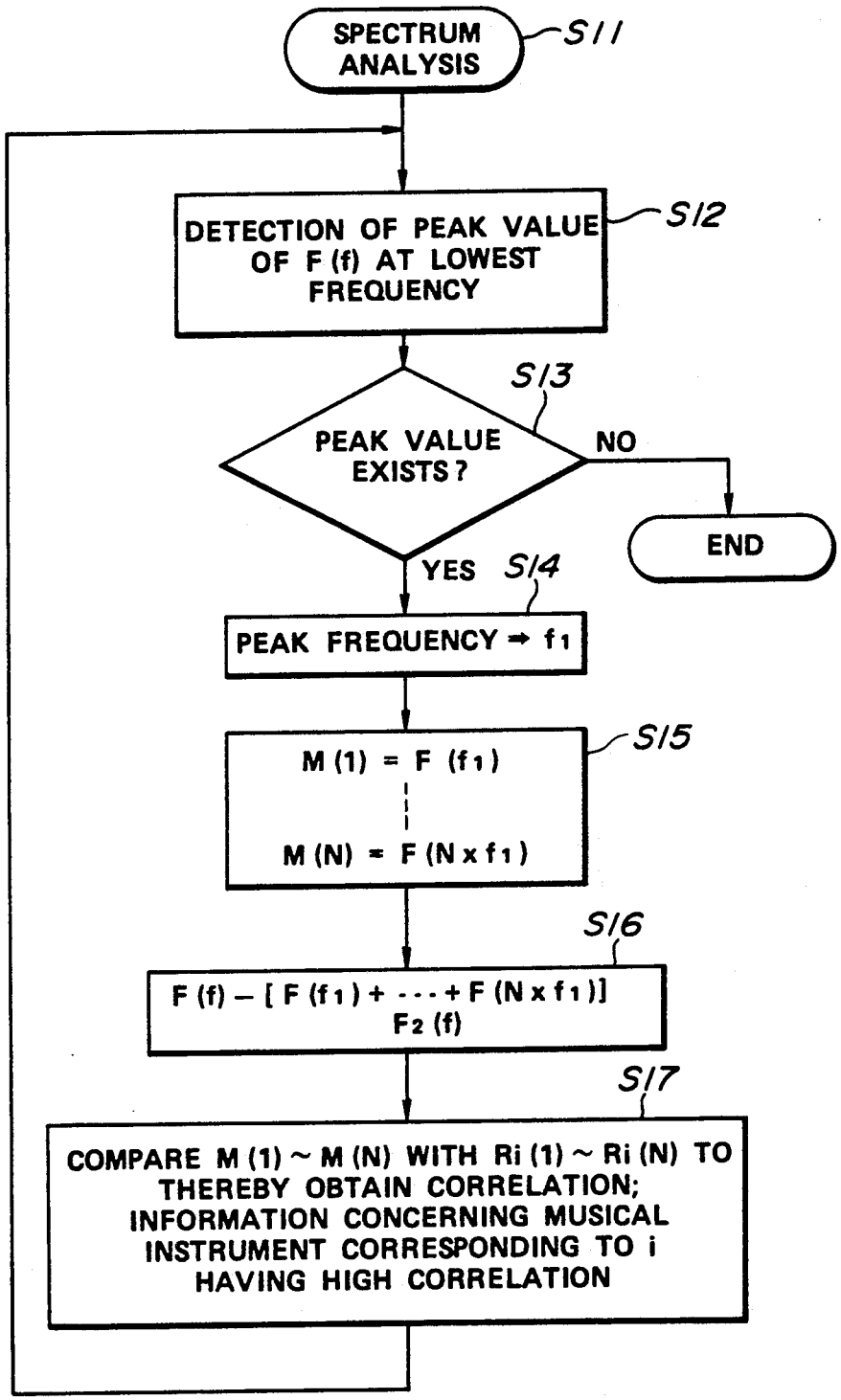

FIG. 7 shows a procedure for detecting the kinds of the musical instruments in the case where the inputted musical tone signal represents a complex tone, i.e., the inputted musical tone signal includes the musical tones of plural musical instruments (i.e., tone colors). In this case, the spectrum memory 33 stores each of spectrum levels $R_1$, ..., $R_1(N)$ of fundamental degree "1"; ...; and spectrum levels $R_L(1)$, ..., $R_L(N)$ of N-degree in response to each of the musical instrument number $i=1...$, L. As shown in FIG. 7, the inputted musical tone signal is subjected to the spectrum analysis to thereby obtain the function F(f), and then the peak value of lowest frequency included in this function F(f) is detected (in steps S11 and S12). If such peak value is detected, the fundamental frequency of the detected peak value is denoted by $f_1$ (in steps S13 and S14). Then, the function values $F(f_1)$, ..., $F(N\times f_1)$ are respectively obtained at frequencies $f_1$, ...., $N\times f_1$, and these function values are denoted by M(l), ..., M(N) (in a step S15). Thereafter, function values at the frequencies $f_1$, ..., $N\times f_1$ are removed from all function values of the function F(f) to thereby obtain a new function, which is denoted as $F_2(f)$ (in a step S16). Next, each of N function values M(l), ..., M(N) having the fundamental frequency $f_1$ is compared with each of the spectrum data $R_i(l)$, ..., $R_i(N)$ stored in the spectrum memory 33 by every musical instrument number i. As a result, the musical instrument number i corresponding to the spectrum data having the high correlation is obtained and then the information thereof is outputted (in a step S17). Thus, the kind of one musical instrument is completely detected, and then the peak value of the lowest frequency is detected again with respect to the function F(f) which is newly determined as described before. After the above peak value is completely detected, the information concerning the kind of musical instrument is outputted by repeatedly executing the process described before. This process is repeatedly executed until there remains no peak value to be detected.

Incidentally, description will be given with respect to the processes shown in FIGS. 6 and 7 as the processes concerning the single and complex tones respectively. However, it is obvious that each of the processes shown in FIGS. 6 and 7 can be modified so that both of the single and complex tones can be applied thereto.

[D] FOURTH EMBODIMENT

Figure 8:
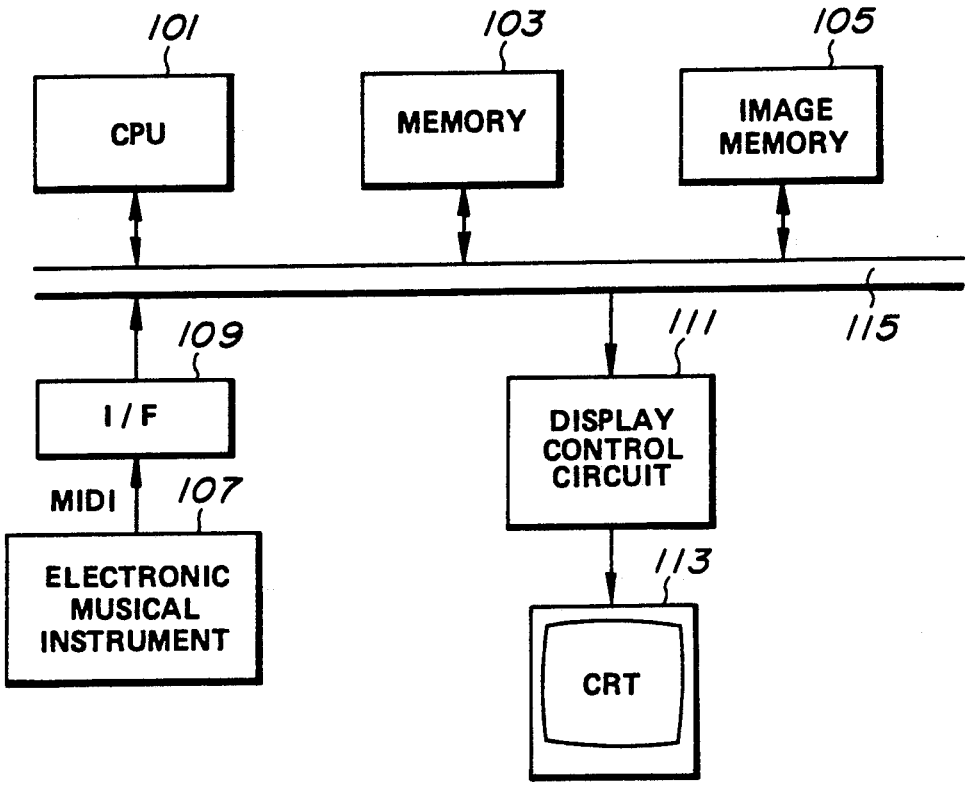
FIG. 8 is a block diagram showing a diagrammatic constitution of the musical tone visualizing apparatus according to a fourth embodiment of the present invention.

FIG. 8 shows the diagrammatic constitution of the musical tone visualizing apparatus according to the fourth embodiment of the present invention. The apparatus shown in FIG. 8 comprises a CPU 101 consisting of the microprocessor etc., a memory 103 for storing several kinds of data, an image memory 105, an interface (I/F) circuit 109 which converts a formation of data outputted from an electronic musical instrument 107 into a formation suitable for being processed by the CPU 101, a display control circuit 111, a display unit 113 such as the CRT display unit and a bus line 115 for connecting the CPU 101, the memory 103, the image memory 105, the interface circuit 109 and the display control circuit 111 etc. Incidentally, the image memory 105 can be constituted by a semiconductor, video disk player (VD player) or a video tape recorder (VTR), for example. This image memory 105 memorizes image information for displaying the picture of the musical instrument in correspondence with the kind of each musical instrument, for example. In addition, the image memory 105 memorizes information representative of the kind of the rhythm musical instrument which is used for rhythm performance by every rhythm kind, for example.

Figure 9:
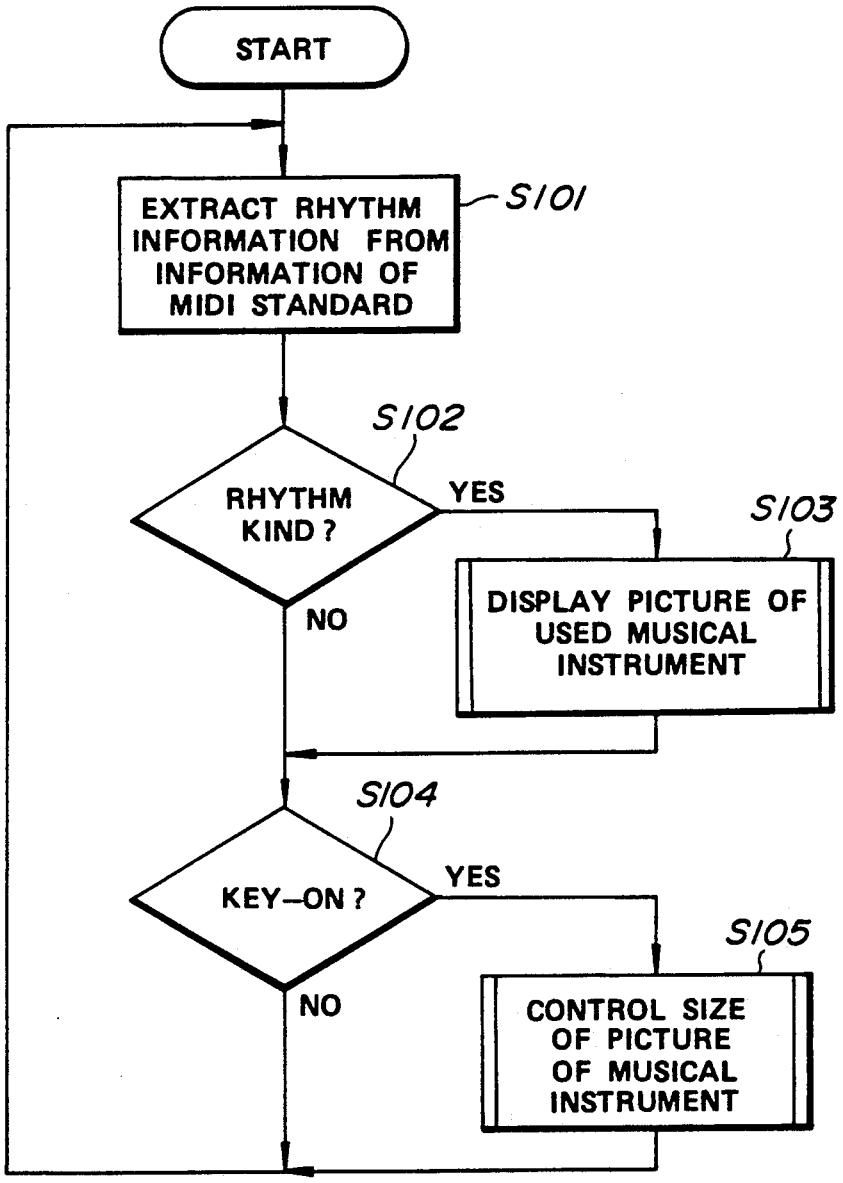
FIG. 9 is a flowchart for explaining an operation of the apparatus shown in FIG. 8.

Next, description will be given with respect to the operation of the apparatus shown in FIG. 8 by referring to FIG. 9. In the apparatus shown in FIG. 8, the electronic musical instrument 107 provides normal rhythm selecting switches, hence, it is possible to select a desirable rhythm kind by operating the rhythm selecting switches so that a rhythm performance tone (i.e., the musical tone) can be automatically generated. More specifically, the desirable rhythm is selected by operating the rhythm selecting switches, and then a rhythm start switch is operated so that data for performing the selected rhythm are read from a rhythm pattern memory provided within the electronic musical instrument 107. This data include tone generation information (i.e., key-on information) representative of kinds of tones of several rhythm musical instruments and a timing for generating each tone of the rhythm musical instrument, which is necessary for performing the rhythm, for example. In addition, this data includes velocity information representative of tone volume levels (i.e., the velocity) and the like. Based on such rhythm data which are read out as described above, each tone source of a rhythm musical instrument generates tones at predetermined timings, so that the rhythm tones will be generated.

When the above-mentioned rhythm performance operation and the keyboard performance operation of the electronic musical instrument are executed, each performance information is outputted from the electronic musical instrument in accordance with a certain musical data format, for example, the Musical Instrument Digital Interface (MIDI) standard. Hereinafter, description will be given on the condition that the MIDI standard is adopted as the certain musical data format such. Such each performance information is transmitted to the CPU 101 and the memory 103 via the interface circuit Bog. As shown in FIG. 9, the CPU LOIN extracts the rhythm information from the information of MIDI standard (in a step S101). As is well known, this rhythm information includes rhythm kind information representative of the rhythm kind (i.e., rhythm number) selected by the above-mentioned rhythm selecting switches, the key-on information for designating a generation of each tone of a rhythm musical instrument, the velocity information which is paired with this key-on information to thereby control the tone volume level of each tone of a rhythm musical instrument to be generated, information for controlling start/-stop of the rhythm performance and other information. Next, it is judged whether the extracted rhythm information represents the rhythm kind information or not (in a step S102). In this case, the memory 103 stores data representative of the kind of each rhythm musical instrument whose tone is generated (or which is used) in the rhythm performance of each rhythm kind, for example. So, if it is judged that the extracted rhythm information represents the rhythm kind information, data representative of the kind of musical instrument corresponding to the selected rhythm kind are read from the memory 103. Such data representative of the kind of musical instrument are inputted to the image memory 105 so that the image information for displaying the picture of a musical instrument designated by this data will be read from the image memory 105. This image information is inputted to the display unit 113 via the display control circuit 111. Thus, the display unit 113 displays the picture of a musical instrument corresponding to the selected rhythm kind (in a step S103).

Meanwhile, when the CPU 101 detects that the extracted rhythm information represents the key-on information (in a step S104), the display control circuit 111 controls the size of the picture of a musical instrument whose tone is designated to be generated by the key-on information under control of the CPU 101 (in a step S105). In this case, the size of the picture of a musical instrument is controlled to become large, and this size is also adjusted in response to the velocity information which is transmitted to the CPU 101 as the pair of the key-on information. Such control described heretofore is executed while the electronic musical instrument 107 plays the rhythm performance.

Figure 10:
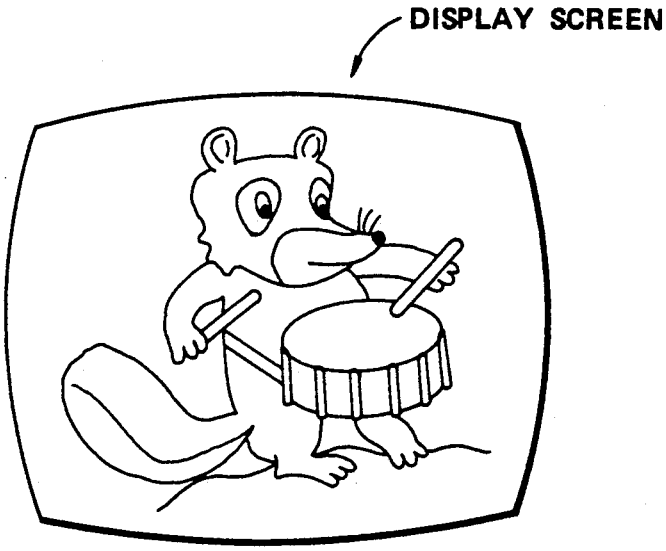
FIG. 10 is a view showing an example of a picture displayed by an image display unit used in the apparatus shown in FIG. 8.

In this fourth embodiment, description has been given with respect to the case where the display unit 113 is controlled to display the picture of a musical instrument. However, it is possible to display an image indicative of the rhythm musical instrument (i.e., percussive musical instrument) and its player in the display unit 113, for example. In this case, it is possible to control the display unit 113 so that the performance of musical a instrument will be executed by the player in response to the key-on information and then the size and state thereof will be controlled by the velocity information. For example, it is possible to set the player as an animal as shown in FIG. 10. In this case, it is possible for that animal to swing down its right and left hands in response to the key-on information so that the animal can beat the rhythm musical instrument such as a snare drum, for example. This image display control described heretofore can be easily realized by use of the computer graphic technique, hence, detailed description thereof will be omitted.

In addition, in the apparatus shown in FIG. 8, image display means can display the picture of a desirable object such as the musical instrument corresponding to the rhythm kind. In this case, it is possible to vary color parameters (i.e., brightness, saturation and hue) of this object or background in synchronism with a rhythm pattern (i.e., the key-on information). More specifically, the hue or brightness etc. of the object is varied in response to the nature of the rhythm kind so that it is possible to execute the image display matching with the image of the rhythm. Further, it is possible to jointly use the control of the color parameters of the object or background together with the control of the size of the musical instrument or the performance operation of the musical instrument described before.

Furthermore, the fourth embodiment automatically plays the rhythm performance corresponding to the rhythm kind selected by the rhythm selecting switches. However, the display control operation of this fourth embodiment can be applied to the case of so-called manual rhythm performance where the rhythm performance is executed by manually operating a rhythm key corresponding to each rhythm musical instrument. In this case, a generation state of musical tone to be generated in response to this manual rhythm performance is detected and then data thereof are compared with data pre-stored in a pattern table so that the kind etc. of the rhythm to be performed can be detected.

Incidentally, it is obvious that the rhythm information can be detected from a musical tone signal instead of the performance information.

[E] FIFTH EMBODIMENT

Figure 11:
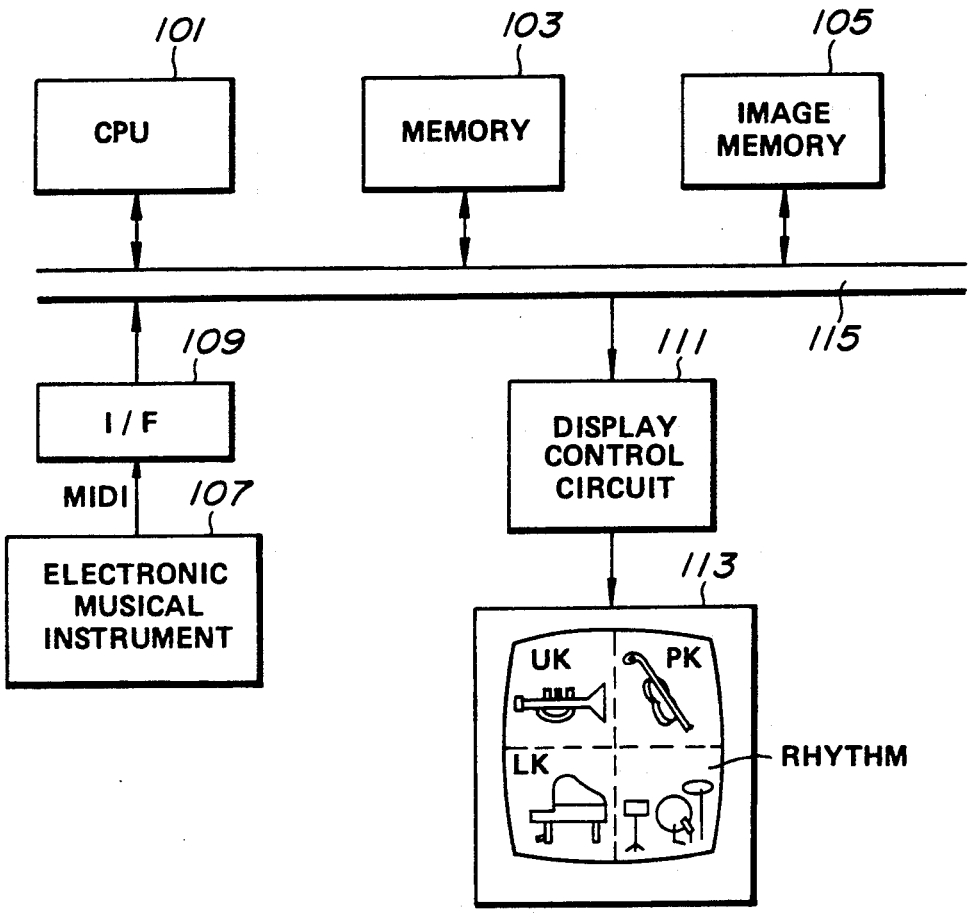
FIG. 11 is a block diagram showing a diagrammatic constitution of the musical tone visualizing apparatus according to a fifth embodiment of the present invention.

Next, description will be given with respect to the musical tone visualizing apparatus according to the fifth embodiment of the present invention by referring to FIG. 11. The present embodiment shown in FIG. 11 has the constitution identical to that of the fourth embodiment shown in FIG. 8, hence, description of each parts thereof will be omitted.

Next, description will be given with respect to an operation of the fifth embodiment. In this apparatus shown in FIG. 11, the display unit 113 displays the pictures of the musical instruments in correspondence with each of the tone colors which can be performed (or selected) by the electronic musical instrument 107 or in correspondence with the representatives of the tone colors which can be performed by the electronic musical instrument 107 in advance. More specifically, the display unit 113 displays pictures of a trumpet, a piano, a bass musical instrument and the rhythm musical instrument as the representatives of upper keys (UK), lower keys (LK), pedal keys (PK) and a rhythm section of the electronic musical instrument 107 respectively. These pictures are displayed by inputting the image information pre-stored in the image memory 105 into the display control circuit 111 and the display unit 113 via the bus line 115. Then, when the electronic musical instrument 107 is performed, the electronic musical instrument 107 outputs the performance information in accordance with the MIDI standard. This performance information is transmitted to the CPU 101 and the memory 103 via the interface circuit 109.

The CPU LOIN detects tone color information and key operation information together from the above performance information. The tone color information is obtained by operating tone color buttons of the electronic musical instrument 107, while the key operation information is detected by the CPU 101 in order to judge the level of the musical tone having such tone color. More specifically, in the case where the tone color is selected by every key (KB), the level of the musical tone having the selected tone color is detected based on key-on/off information, touch level information, information concerning a member for adjusting the tone volume level and the like by every key. In addition, in the case where such member for adjusting the tone volume level is provided by every tone color, the level of the musical tone of each tone color is detected based on an operating state of each member. Then, the CPU 101 outputs information concerning the tone color and the level of the musical tone thereof, and this information is inputted to the display control circuit 111 via the bus line 115.

Based on the above information, the display control circuit 111 selects a picture of musical instrument corresponding to the tone color of presently played musical instrument within the pictures of musical instruments displayed on the display screen of the display unit 113, and then the display size of such selected picture of musical instrument is controlled to be varied in response to the level of the tone color of musical signal. Thus, the display size of the presently played musical instrument is varied in response to the level of the corresponding tone color. In addition, in the case where a plurality of tone colors are performed at the same time, the display size of the musical instrument corresponding to each tone color must be varied in response to tone volume balance of each tone color. Incidentally, instead of varying the display size of musical instrument in response to the performance, it is possible to control the corresponding musical instrument to execute the performance operation so that keys of piano will be moved up and down, for example.

[F] SIXTH EMBODIMENT

Figure 12:
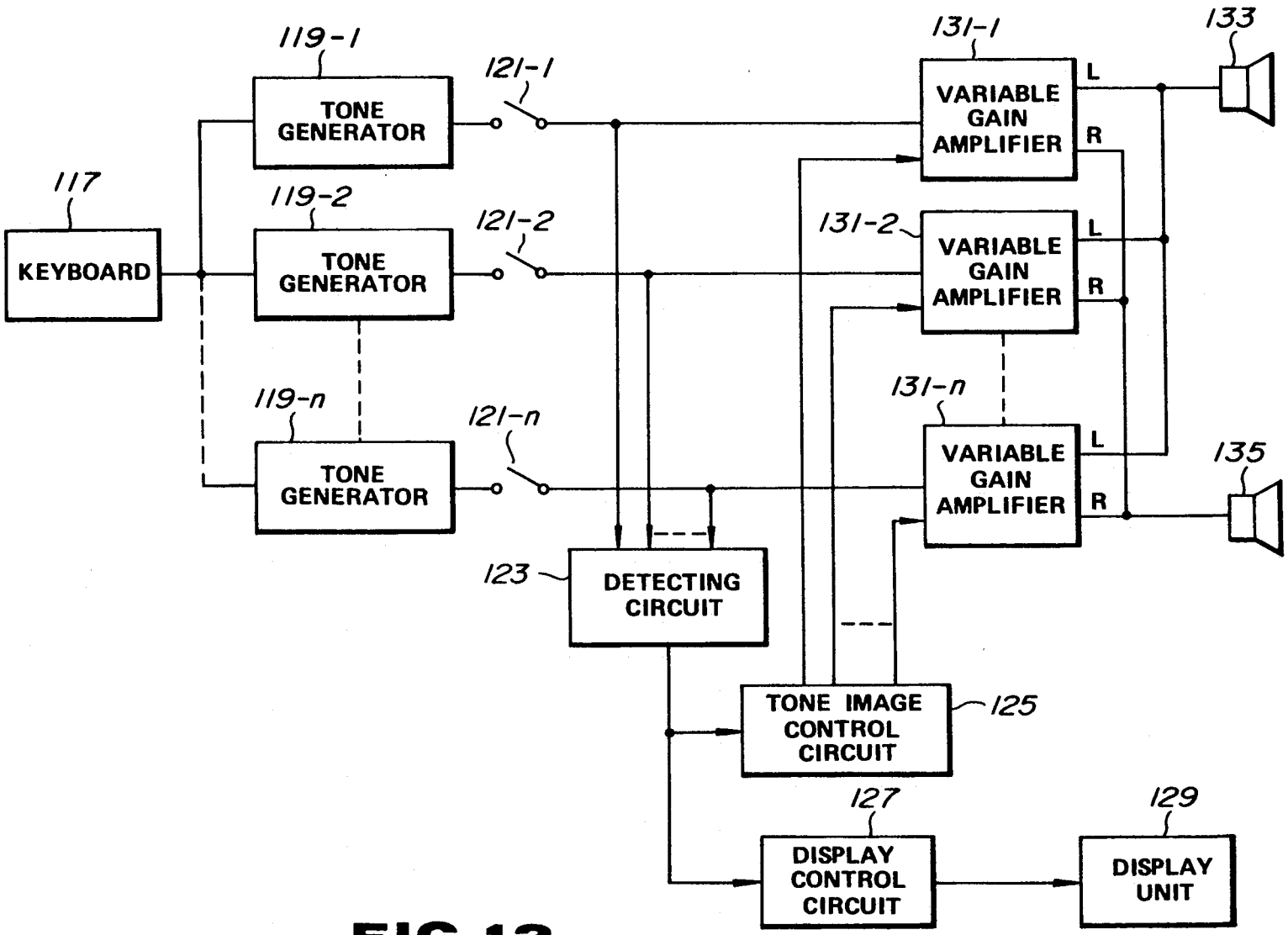
FIG. 12 is a block diagram showing a diagrammatic constitution of the musical tone visualizing apparatus according to a sixth embodiment of the present invention.

FIG. 12 shows the diagrammatic constitution of the musical tone visualizing apparatus according to the sixth embodiment o the present invention. The apparatus shown in FIG. 12 comprises tone generators 119-1, 119-2, ..., 119-n, tone color selecting switches 121-1, 121-2, ..., 121-n each of which is connected to each of the above tone generators, a detecting circuit 123 for detecting the musical instrument which generate the musical tone having the highest tone volume level, a tone image control circuit 125, a display control circuit 127, a display unit 129 such as the CRT display unit, variable gain amplifier 131-1, 131-2, ..., 131-n each of which is provided for each tone color and which can vary output levels of left (L) and right (R) channels in response to control signals outputted from the tone image control circuit 125, a L channel speaker 133 and a R channel speaker 135. Each of the tone generators 119-1 to 119-n generates the musical tone signal corresponding to the predetermined tone color in response to the performance of the keyboard 117. The tone image control circuit 125 pre-stores position information indicative of each position at which the musical instrument corresponding to each tone color is placed within a performance place. Incidentally, this position information can be written from an external device (not shown) so that the position of each musical instrument can be adjusted to the desirable position.

In the apparatus shown in FIG. 12, the operator turns on one of the tone color selecting switches 121-1 to 121-n corresponding to the desirable tone color, and then the performance will be played by the keyboard 117. In response to the performance of the keyboard 117, some of the tone generators 119-1 to 119-n generate the corresponding musical tone signals, each of which is inputted to one of the variable gain amplifiers 131-1 to 131-n via the tone color selecting switch which is turned on. Normally, plural tone color selecting switches must be turned on in order to generate plural tone colors for the melody, the accompaniment and the bass or in order to perform the melody by using plural musical instruments. Therefore, the plural variable gain amplifiers generate audio signals for the L and R channels. These audio signals of the same channel are mixed together and then supplied to each of the speakers 133 and 135, from which the musical tones will be generated.

In the above-mentioned performance played by the keyboard 117, the detecting circuit 123 detects the levels of the musical tone signals outputted via the tone color selecting switches 121-1 to 121-n to thereby select the tone color having the highest tone volume level. In this case, the detecting circuit 123 detects the levels of the musical tone signals by effecting amplitude modulation (AM) detection to each musical tone signal generated from each tone generator, for example. Then, the detecting circuit 123 outputs information concerning the detected musical instrument which generates the musical tone having the highest tone volume level, and this information is supplied to the tone image control circuit 125 and the display control circuit 127. For instance, the display control circuit 127 controls the display unit 129 to pre-display the pictures of several kinds of musical instruments on the display screen based on the information read from the image memory (not shown in FIG. 12). Based on the information indicative of the musical instrument of the highest tone volume level, the display control circuit 127 zooms up (i.e., enlarges the display size of) the picture of the musical instrument of the highest tone volume level within the displayed pictures of the musical instruments.

Meanwhile, the tone image control circuit 125 selects one of the variable gain amplifiers 131-1 to 131-n corresponding to the tone color of the musical instruments of the highest tone volume level based on the above-mentioned information. Then, the tone image control circuit 125 supplies the control signal including the pre-stored position information to the selected variable gain amplifier. This selected amplifier varies a ratio between the musical tone signals of the L and R channels based on the position information included in the control signal thereof, so that audio output levels of the speakers 133 and 135 will be adjusted. Thus, the tone image of the corresponding musical instrument is fixed at the position designated by the pre-stored position information thereof.

As described heretofore, according to the apparatus shown in FIG. 12, the picture of the musical instrument corresponding to &he tone color of the highest tone volume level is zoomed up on the display screen of the display unit 129, and the tone image of such musical instrument of the highest tone volume level is fixed at the predetermined position in response to the operation of the keyboard 117. Such control of the display image and the tone image can be executed on only one musical instrument corresponding to the tone color of the highest tone volume level. In addition, it is possible to modify the present embodiment so that the musical instrument effected by the above-mentioned control will be sequentially changed in response to the musical instrument of the highest tone volume level detected at every detection timing. Further, instead of selecting the musical instrument of the highest tone volume level, it is possible to select the musical instrument whose key-on/off operations are done most frequently. In this case, the present embodiment is modified so that the control of the display image and the tone image can be executed on this selected musical instrument.

Incidentally, the present embodiment refers to performance information detecting means which detects the tone color and the performance state of the tone color based on the performance information. Instead of this means, it is possible to adopt means which detects the tone color and the performance state of the tone color by effecting the spectrum analysis on the inputted musical tone signal.

According to this sixth embodiment, it is possible to effectively enjoy the performance of the musical instruments by listening to the performance by ear and by watching the images which express natures of the musical tones. In addition, it is possible to express an atmosphere of performance with high reality. For example, it is possible to visualize the image of a solo musical instrument so that the performance can be enjoyed with extreme effect.

[G] SEVENTH EMBODIMENT

Figure 13:
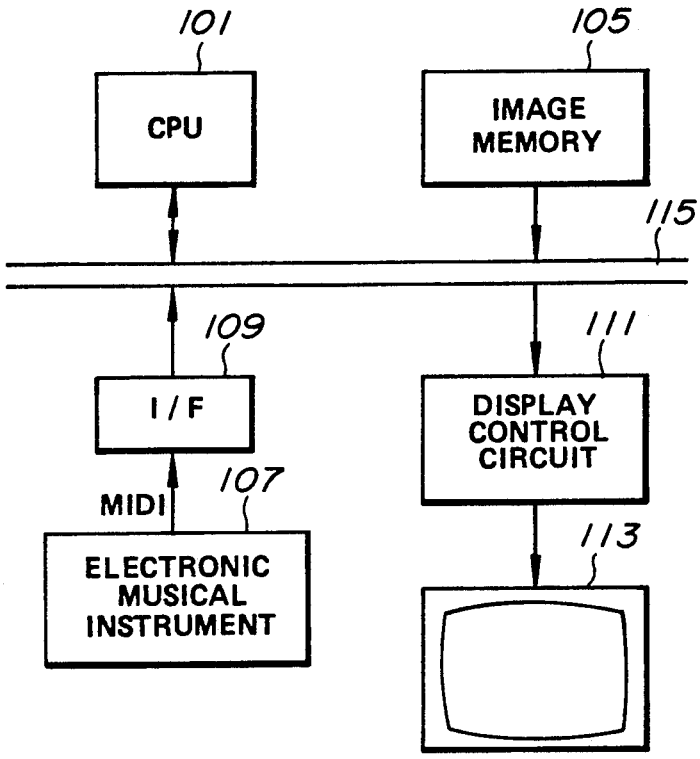
FIG. 13 is a block diagram showing a diagrammatic constitution of the musical tone visualizing apparatus according to a seventh embodiment of the present invention.

Next, description will be given with respect to the seventh embodiment of the present invention bY referring to FIGS. 13 and 14. In FIG. 13, parts identical to those shown in FIGS. 8 and 11 will be designated by the same numerals, hence, the description thereof will be omitted.

In the apparatus shown in FIG. 13, the CPU 101 detects the musical tone parameters such as tone pitch information, tempo information and key operation (i.e., key-on/off) information from the performance information supplied from the electronic musical instrument 107, for example. Such detected musical tone parameters are supplied to the display control circuit 111 via the bus line 115. Based on the above-mentioned several kinds of musical tone parameters, t he display control circuit 111 moves or varies the images of the objects displayed on the display screen of the display unit 113. For instance, in the case where the images of animals are displayed in response to the tone color information described before, each an image of animal can be moved up and down in response to the tone pitch information and also moved in a right direction of the display screen by the speed corresponding to the tempo information. In this case, when the image of an animal reaches at a right edge position of the display screen, this image of the animal can be returned to a left edge position of the display screen and then moved in the right direction of the display screen again. In addition, the image of an animal can be moved in a left direction of the display screen by the speed corresponding to the tempo.

Further, the image of an animal can be moved intermittently in response to the key operation information. More specifically, the image of an animal is moved in the right direction of the display screen in a key-on period, while the image of an animal is stopped in a key-off period. Furthermore, it is possible to express movement feelings of the objects by moving the background image of the objects on the display screen. Incidentally, such image display of the objects and such display control for moving or varying the images of the objects can be easily realized by using the computer graphic techniques, hence, detailed description thereof will be omitted.

Figure 14:
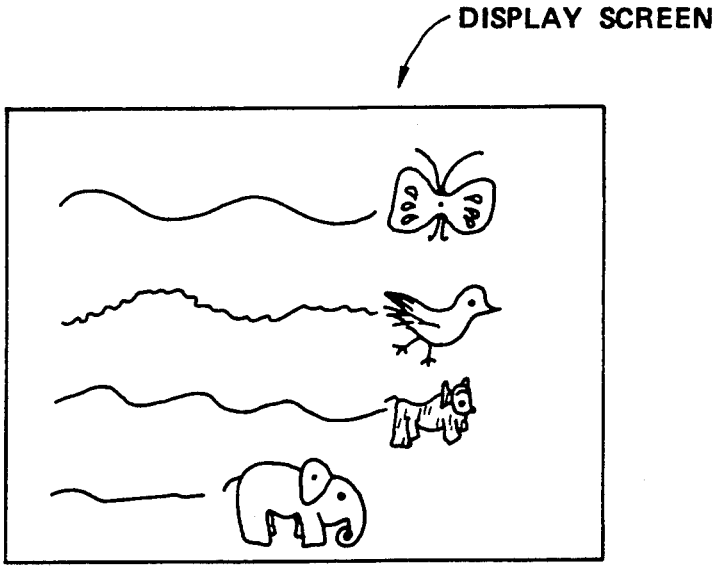
FIG. 14 is a view showing examples of images displayed by the apparatus shown in FIG. 13.

FIG. 14 shows examples of the above-mentioned display images. In FIG. 14, an image of butterfly is displayed in correspondence with the tone color of a flute, an image of a small bird is displayed in correspondence with the tone color of a violin, an image of a dog is displayed in correspondence with the tone color of a trumpet, and an image of elephant is displayed in correspondence with a tone color of a wood bass.

In the present embodiment, the images of animals are moved on the display screen in response to several kinds of the musical tone parameters. Instead of moving the images of animals, it is possible to vary the display size, display color and shape of each of the images of animals in response to the musical tone parameters. In addition, the displayed animal can move in accordance with the predetermined movement in response to the musical tone parameters. For example, the displayed elephant can move its nose up and down.

Incidentally, the kinds of musical tone parameters are not limited to those described in the seventh invention. In addition, the seventh embodiment detects several kinds of musical tone parameters from the performance data. However, it is possible to detect the musical tone parameters from the musical tone (or musical tone signal). For example, it can be considered that the musical tone signal is subjected to the spectrum analysis so as to detect the tone color from each spectrum in the case where the tone color is detected from the musical tone signal.

Above is the description of the preferred embodiments of the present invention. This invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A musical tone visualizing apparatus, comprising:

(a) detecting means for obtaining orchestration information representative of an orchestration of musical instruments from one of a musical tone signal and musical performance information;

(b) image display means for displaying a predetermined image of an object; and (c) display control means for varying the image displayed by said image display means in response to said orchestration information outputted from said detecting means such that said object is animated.

2. A musical tone visualizing apparatus according to claim 1 wherein said image display means displays images indicative of at lest one of players and musical instruments of an orchestra and said orchestration information is information concerning the orchestration scale of the orchestra, said display control means varying at least one of the number of said players and the number of said musical instruments of the orchestra in response to said orchestration information.

3. A musical tone visualizing apparatus according to claim 1 wherein said image display means displays images indicative of at least one of players and musical instruments of an orchestra, said display control means controlling said image display means so that at least one of said musical instruments and said players will be moved in accordance with a predetermined performance operation.

4. A musical tone visualizing apparatus according to claim 1 wherein said orchestration information comprises information concerning kinds of musical instruments, whereby images corresponding to said musical instruments are displayed based on said information concerning the kinds of musical instruments.

5. A musical tone visualizing apparatus according to claim 3 or 4, further comprising:

storing means for storing data representative of a fundamental spectrum of each one of a plurality of musical instruments; and means for effecting a spectrum analysis on an inputted musical tone signal;

wherein the kinds of musical instruments are detected by comparing a result of said spectrum analysis with said fundamental spectrum.

6. A musical tone visualizing apparatus according to one of claims 1 to 4 wherein said orchestration information is obtained from tone color information corresponding to a tone color selecting operation of an electronic musical instrument.

7. A musical tone visualizing apparatus, comprising:

(a) a microphone for collecting musical tones to thereby output musical tone signals;

(b) detect means for detecting an orchestration scale of the musical tones based on said musical tone signals;

(c) control means for outputting a control signal corresponding to the detected orchestration scale of the musical tones;

(d) a plurality of video units each outputting a video signal corresponding to images of at least one of players and musical instruments;

(e) selecting means for selecting one of said video signals outputted from said video units in accordance with said control signal; and (f) display means for displaying said images based on a selected video signal, whereby said display means displays said images corresponding to the orchestration scale of the musical tones, wherein at least one of a displayed player and musical instrument is animated.

8. A musical tone visualizing apparatus according to claim 7 wherein said detect means executes a Fast Fourier Transform on said musical tone signals so that spectrum analysis is effected on said musical tone signals to thereby generate spectrum information; and wherein said control means detects the orchestration scale of the musical tones based on said spectrum information outputted from said detect means so that said control means outputs a control signal corresponding to the detected orchestration scale of the musical tones.

9. A musical tone visualizing apparatus according to claim 8 wherein said control means detects the orchestration scale of the musical tones by counting the number of spectrums each having a peak value which is higher than a predetermined value.

10. A musical tone visualizing apparatus according to claim 7 wherein said detect means detects the orchestration scale of the musical tones by counting a number of peak values of spectrums higher than a predetermined value based on the linear predictive coding method.

11. A musical tone visualizing apparatus according to claim 7, wherein each video unit outputs a video signal corresponding to an orchestration scale which differs from the orchestration scale designated by another video unit.

12. A musical tone visualizing apparatus, comprising:

(a) tone color selecting means for selectively outputting tone color information relating to tone colors;

(b) key information generating means for generating key information based on performance of a keyboard;

(c) memory means for pre-storing image information concerning at lest one of images of players and musical instruments;

(d) control means for reading said image information from said memory means based on said tone color information and said key information; and (e) display means for displaying image of at least one of players and musical instruments corresponding to said image information, said images being varied based on said tone color information and said key information under control of said control means such that at least one of a displayed player and musical instrument is animated.

13. A musical tone visualizing apparatus according to claim 12 wherein said key information comprises information concerning key-on/off states and key codes corresponding to the performance of said keyboard.

14. A musical tone visualizing apparatus according to claim 12, wherein said tone color selecting means further comprises:

tone color selecting switches for selecting said tone color to thereby generate tone color information; and tone color detecting means for detecting said tone color information;

wherein said tone color information comprises first information relating to the selected tone color and second information relating to all tone colors which can be generated, and wherein said display means displays an image of an orchestra based on said second information and said control means controls said display means so that a player corresponding to the selected tone color within said orchestra displayed by said display means will play his performance based on said first information.

15. A musical tone visualizing apparatus according to claim 12, further comprising musical tone generating means for generating a musical tone based on said tone color information and said key information.

16. A musical tone visualizing apparatus comprising:

(a) spectrum memory means for pre-storing fundamental spectrum information for each one of a plurality of tone colors;

(b) means for executing a Fast Fourier Transform on an inputted musical tone signal so that spectrum analysis will be effected on the musical tone signal to thereby obtain a spectrum component;

(c) image memory means for pre-storing images of at least one of players and musical instruments;

(d) control means for comparing said spectrum component with said fundamental spectrum information to thereby detect a kind of musical instrument which is presently played; an (e) display means for selecting an image corresponding to the detected kind of musical instrument from said images stored in said image memory means to thereby display the selected image on a display screen thereof.

17. A musical tone visualizing apparatus according to claim 16 wherein said spectrum memory means prestores said fundamental spectrum information $R_i(f)$ (where i denotes an integral number designating musical instrument number) as the fundamental frequency $F_o$ of the spectrum of each musical instrument, said spectrum memory means effecting said spectrum analysis on the inputted musical tone signal to thereby obtain a function F(f), having a peak value of lowest frequency $f_1$ which is to be detected, said function F(f) being one of extended and reduced based on a ratio of $f_1/f_0$ to thereby obtain a function $F_1(f)$ in said control means, said function $F_1(f)$ being compared with said fundamental spectrum information $R_i(f)$ to thereby obtain correlation thereof, whereby said control means detects said kind of musical instrument based on said musical instrument number i corresponding to said fundamental spectrum information $R_i(f)$ having high correlation with said function $F_1(f)$.

18. A musical tone visualizing apparatus according to claim 16 wherein said control means comprises a microprocessor.

19. A musical tone visualizing apparatus, comprising:

(a) detecting means for detecting information relating to a rhythm of music from one of a musical tone signal and musical tone performance information;

(b) image displaying means for displaying an image of an object based on predetermined image information; and (c) display control means for varying said image displayed by said image display means based on said rhythm information such that said object is animated.

20. A musical tone visualizing apparatus according to claim 19 wherein a display size of said image displayed by said image display means is controlled based on said rhythm information.

21. A musical tone visualizing apparatus according to claim 19 wherein said image is a picture of a musical instrument corresponding to a rhythm kind thereof.

22. A musical tone visualizing apparatus according to claim 21 wherein said image of a musical instrument is controlled to be enlarged in response to tone generation information relating to the corresponding musical instrument.

23. A musical tone visualizing apparatus according to claim 19 wherein said image display means displays images of the musical instrument and player corresponding to a rhythm kind, said display control means controlling performance operation of the player in response to tone generation information relating to the corresponding musical instrument.

24. A musical tone visualizing apparatus according to claim 19 wherein said image display means displays an image of an object corresponding to said rhythm kind, said display control means varying color parameters of at least one of said object and a background thereof in synchronism with a rhythm pattern.

25. A musical tone visualizing apparatus comprising:

(a) an electronic musical instrument for outputting performance information in a certain musical data format, said electronic musical instrument providing rhythm selecting switches for selecting a desirable rhythm kind;

(b) control means for extracting rhythm information from said performance information, said rhythm information including at least rhythm kind information representative of the selected rhythm kind, key-on information indicative of tone generation of each rhythm musical instrument and velocity information for controlling a tone volume level of each rhythm musical instrument;

(c) memory means for storing data representative of a kind of each rhythm musical instrument;

(d) image memory means for storing image information indicative of the rhythm musical instruments, said image memory means inputting said data read from said memory means, so that said image information indicative of the rhythm musical instrument corresponding to the selected rhythm kind is outputted therefrom; and (e) display means for displaying at least an image of the selected rhythm musical instrument which is designated to generate a rhythm musical tone based on said key-on information, wherein display size of said image of the selected musical instrument is controlled based on said velocity information.

26. A musical tone visualizing apparatus, comprising:

(a) image display means for displaying predetermined images of objects each corresponding to one of a plurality of tone colors;

(b) performance information detecting means for detecting a tone color and its performance sate based on one of an inputted musical tone signal and inputted performance information; and (c) display control means for varying an image corresponding to a detected tone color in response to the detected tone color and its performance state such that at least one displayed object is animated.

27. A musical tone visualizing apparatus according to claim 26 wherein said image display means displays an image of a musical instrument indicative of each tone color, while said performance information detecting means controls said display control means so that a display size of each image of a musical instrument will be varied in response to a tone volume of a musical tone having the corresponding tone color.

28. A musical tone visualizing apparatus according to claim 27 wherein said image display means enlarges the display size of the image of a musical instrument whose tone volume is the largest among plural musical instruments.

29. A musical tone visualizing apparatus, comprising:

(a) performance information detecting means for detecting a tone color and its performance state based on one of an inputted musical tone signal and inputted performance information;

(b) image display means for displaying images of musical instruments based on a detected tone color;

(c) position information storing means for storing position information concerning a position of each musical instrument corresponding to a detected tone color;

(d) tone image control means for controlling a position of a tone image corresponding to each detected tone color based on position information concerning said tone image; and (e) display control means for varying a corresponding image of a musical instrument in response to the detected tone color and its performance state.

30. A musical tone visualizing apparatus according to claim 29 wherein said tone image control means enlarges a display size of a musical instrument corresponding to a detected tone color whose tone volume is the largest among plural musical instruments, each corresponding to a detected tone color.

31. A musical tone visualizing apparatus, comprising:

(a) a keyboard;

(b) a plurality of tone generators each generating a musical tone signal based on a performance of said keyboard;

(c) a plurality of tone color selecting switches each connected to each of said tone generators, at least one of said tone color selecting switches being selectively turned on by a player in advance of the performance of said keyboard;

(d) detecting means for inputting said musical tone signals outputted from said tone generators via said tone color selecting switches and then detecting levels of said musical tone signals to thereby select said musical tone signal whose tone volume is maximum, said detecting means outputting information concerning the musical instrument of maximum tone volume; and (e) display means for displaying several kinds of images of musical instruments based on prestored image information in advance, the display size of an image of said musical instrument of maximum tone volume within the displayed images of musical instruments being enlarged based on said information outputted from said detecting means.

32. A musical tone visualizing apparatus according to claim 31 further comprising:

a plurality of variable gain amplifiers each provided corresponding to each tone generator; and tone image control means which pre-stores position information concerning positions of the musical instruments, said tone image control means selecting one of said variable gain amplifiers corresponding to said musical instrument of the maximum tone volume based on said information outputted from said detecting means so that said tone image control means supplies a control signal including said position information to the selected variable gain amplifier, said selected variable gain amplifier amplifying said musical tone signal outputted from the corresponding tone generator via said tone color selecting switch to thereby output amplified musical tone signals of right and left channels whose ratio is varied in response to said position information, whereby musical tones of right and left channels will be generated in accordance with said position information.

33. A musical tone visualizing apparatus, comprising:

(a) first parameter detecting means for detecting a first musical tone parameter from one of an inputted musical tone signal and inputted performance information;

(b) second parameter detecting means for detecting a second musical tone parameter from one of said inputted musical tone signal and said inputted performance information, said second musical tone parameter being set different from said first musical tone parameter;

(c) image display means for displaying an image of an object corresponding to said first musical tone parameter detected by said first parameter detecting means; and (d) display control means for varying a display image of said object in response to said second musical tone parameter detected by said second parameter detecting means.

34. A musical tone visualizing apparatus according to claim 33 wherein said first musical tone parameter represents a kind of tone color, while said second musical tone parameter represents at least one of parameters of tone pitch, tone volume and tempo.

35. A musical tone visualizing apparatus according to claim 34 wherein said first parameter detecting means detects a tone color parameter from operating information of tone color selecting members of an electronic musical instrument as said first musical tone parameter, while said second parameter detecting means simultaneously detects parameters of tempo and tone pitch from key operating information as said second musical tone parameter.

36. A musical tone visualizing apparatus according to claim 34 or 35 wherein said display control means controls said image display means so that the displayed object can be moved in a right or left direction of a display screen of said image display means in response to said parameter of tempo and also moved in an upper or lower direction of said display screen in response to said parameter of tone pitch.

37. A musical tone visualizing apparatus according to claim 36 wherein said displayed object is moved in a key-on period, and said displayed object is stopped in a key-off period.

38. A musical tone visualizing apparatus according to one of claims 34 to 37 wherein said object displayed in response to said kind of tone color is an image of an animal.

* * * * *